US011371290B2

(12) United States Patent
Keller

(10) Patent No.: US 11,371,290 B2
(45) Date of Patent: Jun. 28, 2022

(54) CRACK MITIGATION FOR POLYCRYSTALLINE DIAMOND CUTTERS

(71) Applicant: Halliburton Energy Services, Inc., Houston, TX (US)

(72) Inventor: Christopher John Keller, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 16/609,719

(22) PCT Filed: Jun. 5, 2017

(86) PCT No.: PCT/US2017/035992
§ 371 (c)(1),
(2) Date: Oct. 30, 2019

(87) PCT Pub. No.: WO2018/226208
PCT Pub. Date: Dec. 13, 2018

(65) Prior Publication Data

US 2020/0063499 A1 Feb. 27, 2020

(51) Int. Cl.
*E21B 10/573* (2006.01)
*E21B 10/42* (2006.01)
(Continued)

(52) U.S. Cl.
CPC ..... *E21B 10/5735* (2013.01); *E21B 10/42* (2013.01); *E21B 10/43* (2013.01); *E21B 10/54* (2013.01); *E21B 10/55* (2013.01)

(58) Field of Classification Search
CPC ..... E21B 10/42; E21B 10/43; E21B 10/54; E21B 10/55; E21B 10/5735
See application file for complete search history.

(56) References Cited

U.S. PATENT DOCUMENTS 4,440,573 A * 4/1984 Ishizuka ..... C22C 26/00 75/243
4,766,040 A * 8/1988 Hillert ..... C22C 27/00 428/552
(Continued)

FOREIGN PATENT DOCUMENTS

GB 2298668 A * 9/1996 ..... E21B 10/43
GB 2335682 A * 9/1999 ..... E21B 10/5735

OTHER PUBLICATIONS

ISRWO International Search Report and Written Opinion for PCT/US2017/035992 dated Nov. 29, 2017.

*Primary Examiner* — D. Andrews
*Assistant Examiner* — Ronald R Runyan
(74) *Attorney, Agent, or Firm* — Thomas Rooney; C. Tumey Law Group PLLC

(57) ABSTRACT

A cutting element for a drill bit can include a first layer of polycrystalline diamond, a second layer of polycrystalline diamond, wherein a boundary between the first layer and the second layer is nonplanar, and a substrate. The first and second layers can be formed from polycrystalline diamond of different grain sizes. One of the first and second layers can be leached of a catalyzing material. The first layer can be formed on a first substrate having a nonplanar surface feature, removed from the first substrate, and placed over the second layer to form the nonplanar boundary. The first layer can be leached of a catalyzing material prior to being applied to the second layer. A barrier layer can be placed between the first layer and the second layer to prevent sweeping of a catalyzing material into the leached first layer.

10 Claims, 10 Drawing Sheets

(51) Int. Cl.

| | |
|---|---|
| *E21B 10/54* | (2006.01) |
| *E21B 10/43* | (2006.01) |
| *E21B 10/55* | (2006.01) |

(56) References Cited

U.S. PATENT DOCUMENTS

| | | | | |
|---|---|---|---|---|
| 5,120,327 | A * | 6/1992 | Dennis | B22F 7/06 407/119 |
| 5,351,772 | A * | 10/1994 | Smith | E21B 10/5735 175/428 |
| 5,647,449 | A | 7/1997 | Dennis | |
| 6,193,001 | B1 | 2/2001 | Eyre et al. | |
| 6,216,805 | B1 * | 4/2001 | Lays | C04B 37/021 175/374 |
| 6,258,139 | B1 * | 7/2001 | Jensen | B23B 27/141 428/408 |
| 8,485,284 | B2 | 7/2013 | Sithebe | |
| 8,727,046 | B2 | 5/2014 | Miess et al. | |
| 9,089,951 | B2 | 7/2015 | Bao et al. | |
| 9,103,172 | B1 | 8/2015 | Bertagnolli | |
| 9,316,059 | B1 | 4/2016 | Topham et al. | |
| 2006/0219439 | A1 | 10/2006 | Shen et al. | |
| 2010/0294571 | A1 * | 11/2010 | Belnap | E21B 10/567 175/434 |
| 2011/0031033 | A1 * | 2/2011 | Mourik | E21B 10/567 175/428 |
| 2011/0042148 | A1 | 2/2011 | Schmitz et al. | |
| 2011/0120782 | A1 | 5/2011 | Cooley et al. | |
| 2012/0031675 | A1 | 2/2012 | Truemner et al. | |
| 2012/0222364 | A1 * | 9/2012 | Lyons | B24D 99/005 51/296 |
| 2014/0116789 | A1 | 5/2014 | Sue | |
| 2015/0021100 | A1 * | 1/2015 | Cheng | E21B 10/5673 175/428 |
| 2015/0027787 | A1 | 1/2015 | Scott et al. | |
| 2015/0135603 | A1 | 5/2015 | Can et al. | |

* cited by examiner

CRACK MITIGATION FOR POLYCRYSTALLINE DIAMOND CUTTERS

TECHNICAL FIELD

The present description relates in general to multilayered polycrystalline diamond and polycrystalline diamond-like elements, and more particularly to, for example, without limitation, polycrystalline diamond cutters having layers defined by nonplanar boundaries for crack mitigation.

BACKGROUND OF THE DISCLOSURE

Drill bits and components thereof are often subjected to extreme conditions (e.g., high temperatures, high pressures, and contact with abrasive surfaces) during subterranean formation drilling or mining operations. Polycrystalline diamond ("PCD") bodies are often used at the contact points between the drill bit and the formation because of their wear resistance, hardness, and ability to conduct heat away from the point of contact with the formation.

Exemplary PCD cutting elements known in the art can include a substrate, a PCD body, and optionally one or more transition or intermediate layers to improve the bonding between and/or provide transition properties between the PCD body and the underlying substrate. Substrates used in such cutting element applications include carbides such as cemented tungsten carbide.

The PCD body can be formed from one or more layers of PCD material applied to a substrate material. A variety of diamond grains of different sizes can be used to provide a target particle density within a given volume. The PCD body can be formed by mixing the diamond particles and a catalyzing material (e.g., cobalt, nickel, iron, Group VIII elements, and alloys thereof) followed by high-pressure, high-temperature ("HPHT") sintering. The catalyzing material facilitates bonding between the diamond particles into a larger, polycrystalline diamond table.

Figure 1:
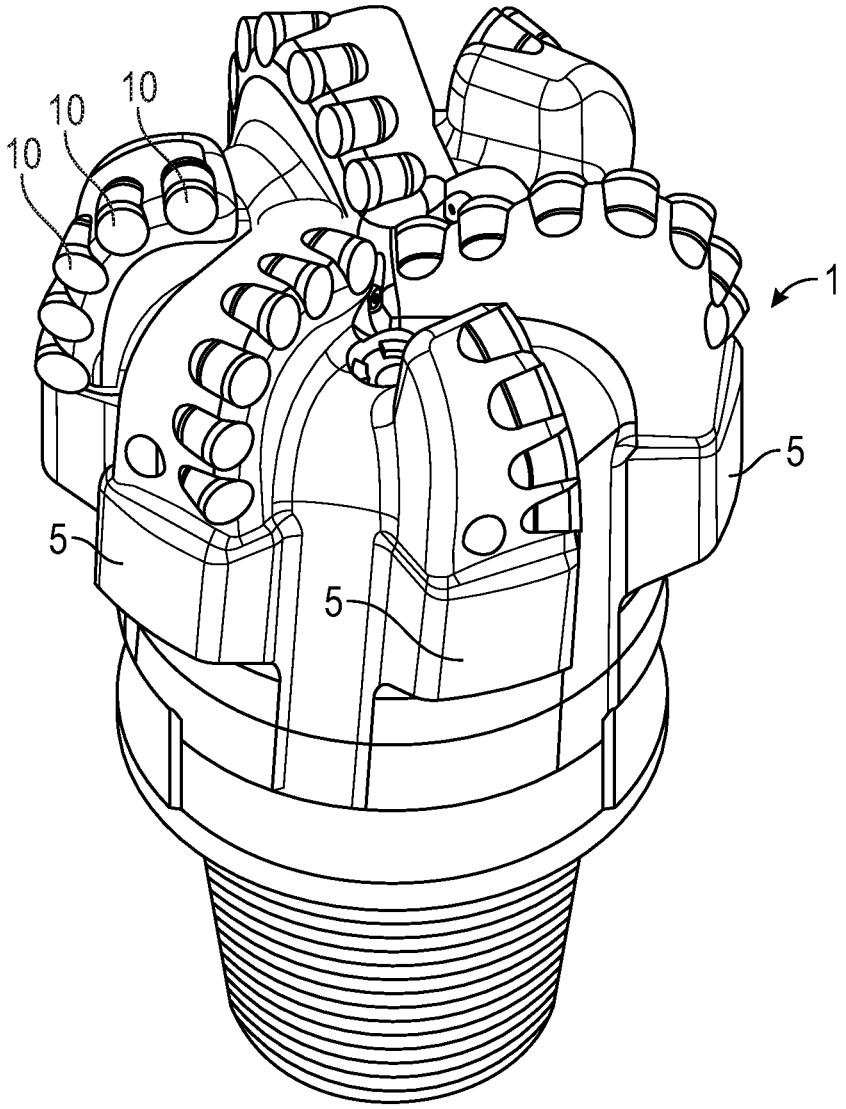
FIG. 1 is a perspective view of a fixed blade rotary drill bit having PCD cutting elements mounted to cutting blades, according to some embodiments.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Polycrystalline diamond and polycrystalline diamond-like elements can be formed with a catalyzing material in a HPHT process. A PCD body formed in such a manner can have partially bonded diamond or diamond-like crystals forming a continuous diamond matrix table or body. A catalyzing material allows the intercrystalline bonds to be formed between adjacent diamond crystals at the relatively low pressures and temperatures obtainable in a press suitable for commercial production.

A variety of techniques can be applied to enhance at least one mechanical property of the PCD body, such as abrasion resistance, thermal stability, and impact resistance. For example, residual stresses in PCD bodies may occur after HPHT processing due to the difference in thermal expansion between the PCD body and the substrate. The PCD body can be formed from at least one layer of diamond particles having a relatively coarse average particle size adjacent to the substrate and at least another layer of diamond particles having a relatively fine average particle size that is positioned near an upper, working surface of the PCD body. This layering can mitigate related high residual tensile stresses and provide for relatively more secure bonding of the PCD body to the substrate. The layering of coarse and fine diamond particle sizes may also limit infiltration of the fine average particle size region with infiltrant from the substrate during HPHT processing to enhance at least one of abrasion resistance, thermal stability, or impact resistance during use of the resulting cutting element.

Layers of a PCD body with distinct properties can also result from a leaching process. A catalyzing material remaining from the HPHT process can cause cracks due to a higher coefficient of thermal expansion compared to diamond and cause graphitization at diamond grain boundaries. The fractures and graphitization can weaken the PCD body and may lead to a reduced lifetime for the drill bit. To reduce fracturing, at least some of the catalyzing material can be leached from the interstitial spaces of the polycrystalline diamond table before exposing the polycrystalline diamond table to elevated temperatures. Catalyzing material can be removed by leaching, which commonly includes exposing the diamond to strong acids at elevated temperatures that dissolve the catalyzing material. Generally, in a strong acid treatment, the acid penetrates into the interstitial space of the polycrystalline diamond table, contacts the catalyst, and dissolves a portion of the catalyzing material by forming a water-soluble salt. The dissolved salt traverses the interstitial spaces to be removed from the polycrystalline diamond table. Below the leached layer, there can remain an unleached layer, in which the catalyzing material remains to securely bond the PCD body to the substrate on which it is mounted.

Thus, the use of layers formed from different grain sizes and layers that are leached and unleached can contribute to desirable mechanical properties of the cutting element. However, the separation of the PCD body into layers also provides a boundary at which cracks can form and propagate. The PDC body has a tendency to chip or spall along the boundary. A smooth or planar transition allows for an easy pathway for crack propagation between two diamond feeds or along a leach boundary, reducing toughness of PDC body. If a planar boundary crosses the longitudinal axis of a cutting element, cracks can propagate across the boundary until an entire layer of the PCD body is removed.

According to aspects of the present disclosure, the benefits of diverse grain sizes and leaching can be achieved while mitigating crack propagation at layer boundaries. A nonplanar boundary can be provided between layers of a PCD body. The nonplanar profile of the boundary provides stress concentrators that direct forces away from the boundary and into one of the layers forming the boundary. The deflection of crack propagation reduces the amount of material that is removed from a cutting element. As such, less than an entire layer can be removed, and the remaining portion of the layer can continue to operate. The nonplanar boundaries can be adapted to reduce the effects of wear, to allow the cutting element to be used for longer periods in effectively cutting through material, thereby dramatically increasing the drilling performance of drill bits incorporating the cutting element. Drill bits containing cutting elements of this character are able to drill continuously for longer periods of time and for further distances before the cutting elements become blunted and the drill bit has to be tripped out and exchanged. Cutting elements formed in this manner are also more resistant to cracking or fracture and so are less susceptible to failure during a drilling operation, improving the reliability of a drill bit incorporating the cutting elements.

Referring to FIG. 1, a fixed blade rotary drill bit 1 can have multiple cutting blades 5 arranged to extend substantially radially from a central longitudinal axis of the drill bit 1. Each of the cutting blades 5 can be provided with a plurality of PCD cutting elements 10 mounted to face in a direction of rotation of the cutting blades 5 while in operation. The PCD cutting elements 10 can be mounted to have a rake angle, this being the angle at which the working surface 28 of the cutting element 10 approaches the material of the formation to be cut, as the cutting blade 5 on which the cutting element 10 is mounted rotates in operation of the drill bit 1. In application to a fixed blade rotary drill bit, the cutting elements 10 are received within a correspondingly shaped socket or recess in the cutting blades 5. The cutting elements 10 can be brazed or shrink-fitted into the sockets.

Figure 2:
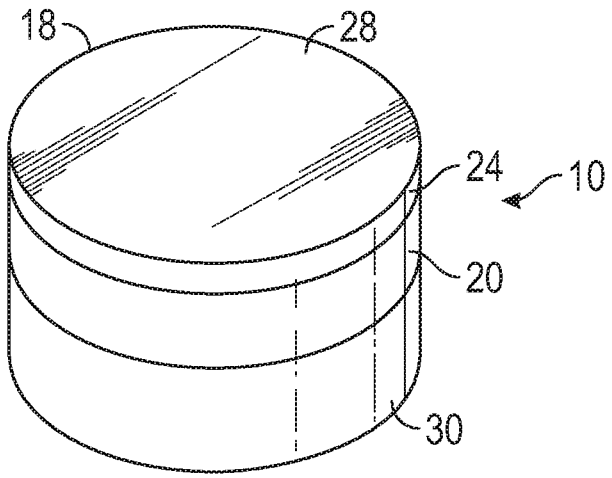
FIG. 2 is a perspective view of a PCD cutting element, according to some embodiments.

Referring now to FIG. 2, a PCD cutting element 10 can include a PCD body 18, attached integrally or otherwise bonded to a substrate 30. The substrate 30 can be of a less hard material than the PCD body 18. For example, the substrate 30 can include cemented tungsten carbide, steel, or another material, such as titanium carbide, chromium carbide, niobium carbide, tantalum carbide, vanadium carbide, or combinations thereof cemented with iron, nickel, cobalt, or alloys thereof.

The PCD body 18 can include a matrix of intercrystalline bonded diamond crystals or other particles which define, between the crystals, interstitial spaces which are substantially interconnected to provide an interstitial matrix. The interstitial matrix can be filled, during formation of the PCD body 18 in a HPHT process with the catalyzing material, which promotes the formation of the intercrystalline bonds. On initial formation of the PCD body 18, substantially all of the interstices can contain the catalyzing material therein. A leaching process can be applied to remove the catalyzing material from the PCD body 18 or a portion thereof, as discussed further herein.

As shown in FIG. 2, the PCD body 18 can be substantially cylindrical, being circular in cross-section and having a working surface 28 which is substantially perpendicular to the longitudinal axis of the cylinder. Other geometries are contemplated, such as a non-cylindrical PCD body 18 (e.g., oval, elliptical, dome-shaped) and/or a working surface 28 that is not perpendicular to the longitudinal axis of the body.

The PCD body 18 can include multiple PCD layers that provide enhanced crack mitigation properties to the PCD cutting element 10. For example, as shown in FIG. 2, the PCD body 18 can include an upper layer 24 and a lower layer 20. Additional layers can be provided. The layers of the PCD body 18 can have different properties or characteristics, as discussed further herein.

Figure 3:
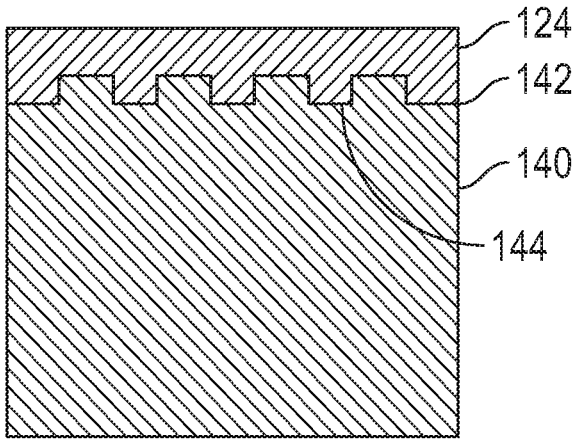
FIG. 3 is a schematic diagram of a PCD upper layer formed on a first substrate, according to some embodiments.
Figure 4:
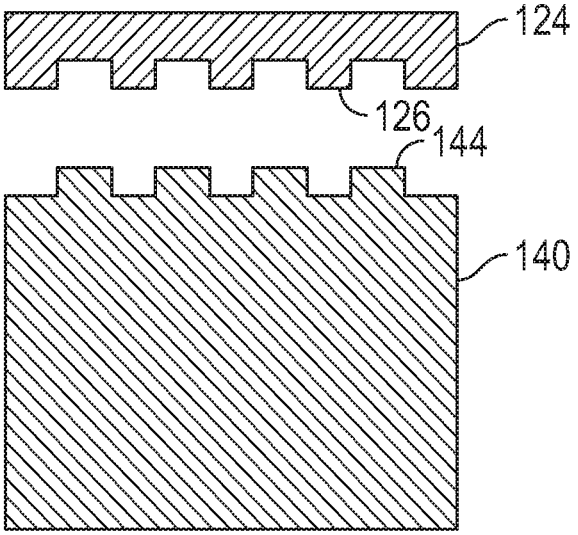
FIG. 4 is a schematic diagram of the PCD upper layer separated from the first substrate, according to some embodiments.
Figure 5:
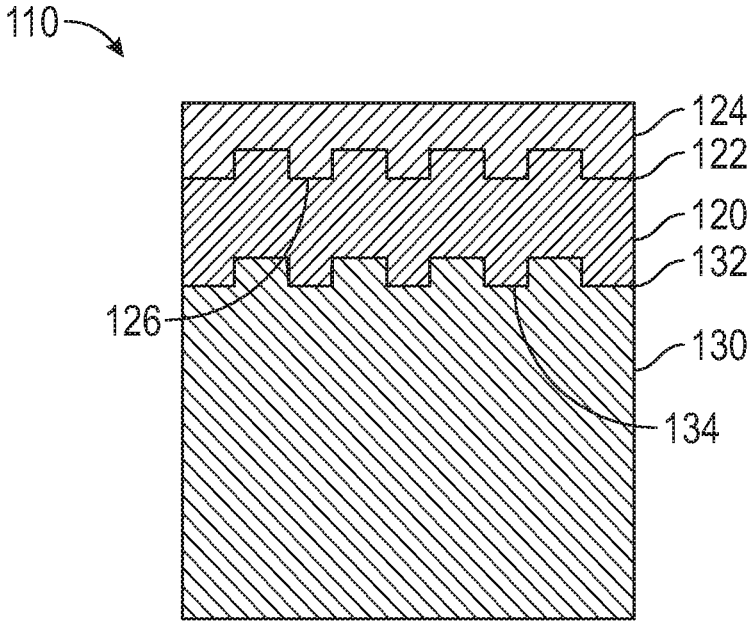
FIG. 5 is a schematic diagram of a cutting element including the PCD upper layer and a PCD lower layer integrally formed on a second substrate, according to some embodiments.

Referring now to FIGS. 3-5, multiple layers of a PCD body can be integrally formed with a substrate to produce a cutting element 110 that is similar in at least some respects to the cutting element 10 of FIG. 2. The cutting element 110 can include multiple PCD layers having different characteristics, such as diamond grain sizes. The different characteristics of the separate layers can enhance mechanical properties of the PCD body, such as abrasion resistance, thermal stability, and impact resistance. However, the boundary between the layers may be susceptible to cracking and shearing along the boundary, which may result in an entire layer being removed from the cutting element. A nonplanar boundary can be formed between the separate layers to provide crack mitigation at the boundary. The nonplanar boundary can direct propagation of a crack away from the boundary line, such that only a portion of a layer, rather than an entirety of the layer, is removed due to cracking.

As shown in FIG. 3, an upper layer 124 can be formed on a first substrate 140 having a first surface feature 144. It should be appreciated that the drawings are principally schematic in nature, intended to convey the subject technology without necessarily expressing the relative sizes, shapes and dimensions of the components illustrated. In particular, certain features may be shown enlarged or exaggerated relative to other features, merely for illustrative purposes. The first surface feature 144 can include a texture, surface roughness, a pattern, protrusions, peaks, valleys, grooves, and combinations thereof. As the upper layer 124 is applied as a powder to the first substrate 140, the powder can substantially conform to the first surface feature 144 of the first substrate 140. Accordingly, a nonplanar boundary 142 is formed between the upper layer 124 and the first substrate 140. As used herein, a boundary or surface is nonplanar if a surface roughness (i.e., peak-to-trough height) thereof is greater than the size of particles thereof or placed thereon, such that the particles. The surface roughness of the first surface feature 144 and/or the nonplanar boundary 142 can be greater than a minimum, maximum, or average grain size of the upper layer 124. For example, the first surface feature 144 and/or of the nonplanar boundary 142 can include a minimum, maximum, or average surface roughness (e.g., peak-to-trough height) that is at least about 1.5 times, about 2.0 times, about 2.5 times, about 3.0 times, about 3.5 times, about 4.0 times, about 4.5 times, about 5.0 times, about 5.5 times, or about 6.0 times a minimum, maximum, or average grain size of the upper layer 124. By further example, the first surface feature 144 and/or of the nonplanar boundary 142 can include a minimum, maximum, or average surface roughness (e.g., peak-to-trough height) that is at least about 10 μm, about 20 μm, about 30 μm, about 40 μm, about 50 μm, about 60 μm, about 70 μm, about 80 μm, about 90 μm, or about 100 μm. The upper layer 124 and the first substrate 140 can be subjected to a HPHT process, for example, with catalyzing material to promote the formation of intercrystalline bonds. Alternatively or in combination, the upper layer 124 can be formed on the first substrate 140 without a HPHT process. For example, the upper layer 124 can be 3D printed, laser sintered, and/or stamped onto the first substrate 140. An adhesive or other binding material can be provided to bond the upper layer 124 together. The upper layer 124 can include binder-coated diamond that is printed.

As shown in FIG. 4, the upper layer 124 can be removed from the first substrate 140. In some embodiments, the first substrate 140 is permanently altered or destroyed to separate it from the upper layer 124, for example by a laser of EDM process. After removal, the upper layer 124 can maintain an upper surface feature 126 corresponding to the first surface feature 144 of the first substrate 140.

As shown in FIG. 5, the upper layer 124 and a lower layer 120 can be formed on a second substrate 130 having a second surface feature 134. The second surface feature 134 can include a texture, a pattern, a surface roughness, protrusions, peaks, valleys, grooves, and combinations thereof. The second surface feature 134 can be the same as or different from the first surface feature 144. As the lower layer 120 is applied as a powder to the second substrate 130, the powder can substantially conform to the second surface feature 134 of the second substrate 130. As the upper layer 124, now hardened, is applied to the lower layer 120, the powder of the lower layer 120 can substantially conform to the upper surface feature 126 of the upper layer 124. Accordingly, a nonplanar boundary 122 is formed between the upper layer 124 and the lower layer 120, and a nonplanar boundary 132 is formed between the lower layer 120 and the second substrate 130. The surface roughness of the second surface feature 134 and/or the nonplanar boundary 122 can be the same as or different from the surface roughness of the first surface feature 144 and/or the nonplanar boundary 142. For example, the surface roughness of the second surface feature 134 and/or the nonplanar boundary 122 can be greater than a minimum, maximum, or average grain size of the lower layer 120. The upper layer 124, the lower layer 120, and the second substrate 130 can be subjected to a HPHT process, for example, with catalyzing material to promote the formation of intercrystalline bonds. The resulting cutting element 110 can include the upper layer 124, the lower layer 120, and the second substrate 130, wherein the boundary 122 between the upper layer 124 and the lower layer 120 is nonplanar, and wherein the boundary 132 between the lower layer 120 and the second substrate 130 is nonplanar.

After the separate layers are formed with intercrystalline bonds, evidence of the grain sizes can be observed. For example, some interstitial spaces between grains can remain after the HPHT process. At least some of the boundaries of the grains can be observed, for example, with scanning electron microscopy.

The lower layer 120 can include a grain size that is coarser than a grain size of the upper layer 124. For example, the minimum, maximum, or average grain size of the upper layer 124 can be at most about 10 μm, about 20 μm, about 30 μm, about 40 μm, about 50 μm, about 60 μm, about 70 μm, about 80 μm, about 90 μm, or about 100 μm, and the minimum, maximum, or average grain size of the lower layer 120 can be at least about 10 μm, about 20 μm, about 30 μm, about 40 μm, about 50 μm, about 60 μm, about 70 μm, about 80 μm, about 90 μm, or about 100 am. By further example, the minimum, maximum, or average grain size of the lower layer 120 can be at least about 1.5 times, about 2.0 times, about 2.5 times, about 3.0 times, about 3.5 times, or about 4.0 times of the minimum, maximum, or average grain size of the upper layer 124. By further example, the minimum, maximum, or average grain size of the lower layer 120 can be at least about 10 μm, about 20 μm, about 30 μm, about 40 μm, about 50 μm, about 60 μm, about 70 μm, about 80 μm, about 90 μm, or about 100 μm greater than the minimum, maximum, or average grain size of the upper layer 124.

Any number of layers can be included in the cutting element 110. For example, the upper layer 124 and the lower layer 120 can be removed from the second substrate 130. An additional layer can be provided, as a powder, between the existing layers and the same or a new substrate. Appropriate surface features can be provided to promote formation of nonplanar boundaries. The layers and the substrate can be subjected to a HPHT process, for example, with catalyzing material to promote the formation of intercrystalline bonds. This process can be repeated as desired to form any number of layers, which can be joined by nonplanar boundaries.

Referring now to FIGS. 6-9, multiple layers of a PCD body can be integrally formed with a substrate to produce a cutting element 210 that is similar in at least some respects to the cutting element 10 of FIG. 2. The cutting element 210 can include multiple PCD layers having different characteristics, such as presence or absence of catalyzing material. Leaching catalyzing material from PCD elements can enhance the properties of the PCD element, such as thermal degradation and impact resistance. However, the boundary between leached and unleached layers may be susceptible to cracking and shearing along the boundary, which may result in an entire layer being removed from the cutting element. A nonplanar boundary can be formed between the separate layers to provide crack mitigation at the boundary. The nonplanar boundary can direct propagation of a crack away from the boundary line, such that only a portion of a layer, rather than an entirety of the layer, is removed due to cracking.

Figure 6:
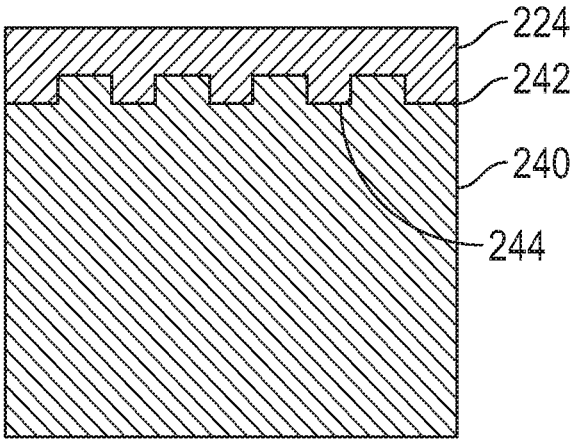
FIG. 6 is a schematic diagram of a PCD upper layer formed on a first substrate, according to some embodiments.

As shown in FIG. 6, an upper layer 224 can be formed on a first substrate 240 having a first surface feature 244. The first surface feature 244 can include a texture, a pattern, a surface roughness, protrusions, peaks, valleys, grooves, and combinations thereof. As the upper layer 224 is applied as a powder to the first substrate 240, the powder can substantially conform to the first surface feature 244 of the first substrate 240. Accordingly, a nonplanar boundary 242 is formed between the upper layer 224 and the first substrate 240. The surface roughness of the first surface feature 244 and/or the nonplanar boundary 242 can be greater than a minimum, maximum, or average grain size of the upper layer 224. For example, the first surface feature 244 and/or of the nonplanar boundary 242 can include a minimum, maximum, or average surface roughness (e.g., peak-to-trough height) that is at least about 1.5 times, about 2.0 times, about 2.5 times, about 3.0 times, about 3.5 times, about 4.0 times, about 4.5 times, about 5.0 times, about 5.5 times, or about 6.0 times a minimum, maximum, or average grain size of the upper layer 224. By further example, the first surface feature 244 and/or of the nonplanar boundary 242 can include a minimum, maximum, or average surface roughness (e.g., peak-to-trough height) that is at least about 10 μm, about 20 μm, about 30 μm, about 40 μm, about 50 μm, about 60 μm, about 70 μm, about 80 μm, about 90 μm, or about 100 μm. The upper layer 224 and the first substrate 240 can be subjected to a HPHT process, for example, with catalyzing material to promote the formation of intercrystalline bonds. Alternatively or in combination, the upper layer 224 can be formed on the first substrate 240 without a HPHT process. For example, the upper layer 224 can be 3D printed, laser sintered, and/or stamped onto the first substrate 240. An adhesive or other binding material can be provided to bond the upper layer 224 together. The upper layer 224 can include binder-coated diamond that is printed.

Figure 7:
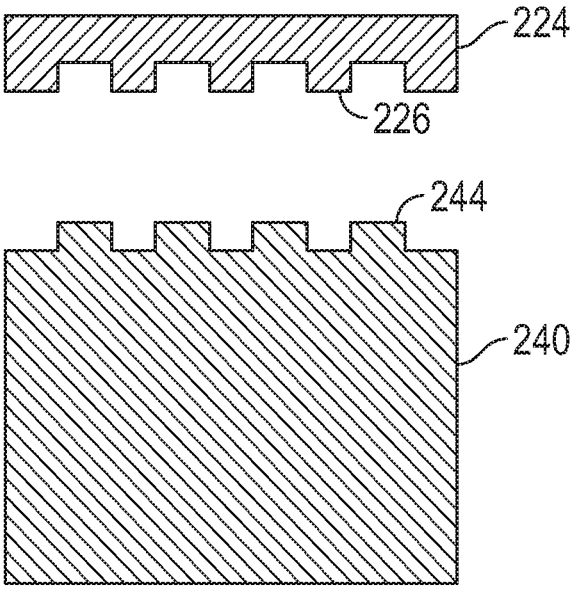
FIG. 7 is a schematic diagram of the PCD upper layer separated from the first substrate, according to some embodiments.

As shown in FIG. 7, the upper layer 224 can be removed from the first substrate 240. In some embodiments, the first substrate 240 is permanently altered or destroyed to separate it from the upper layer 224, for example by a laser of EDM process. After removal, the upper layer 224 can maintain an upper surface feature 226 corresponding to the first surface feature 244 of the first substrate 240. The upper layer 224 can be subjected to a leaching process to remove at least some of the catalyzing material from the upper layer 224. The upper layer 224 can be leached to a depth that extends partially or completely through the body of the upper layer 224. The leaching can be performed from upon one, some, or all sides, such that the leach depth need not be a full dimension across the upper layer 224. For example, the leach depth can be at least half and less than a full distance across opposing sides of the upper layer 224.

Figure 8:
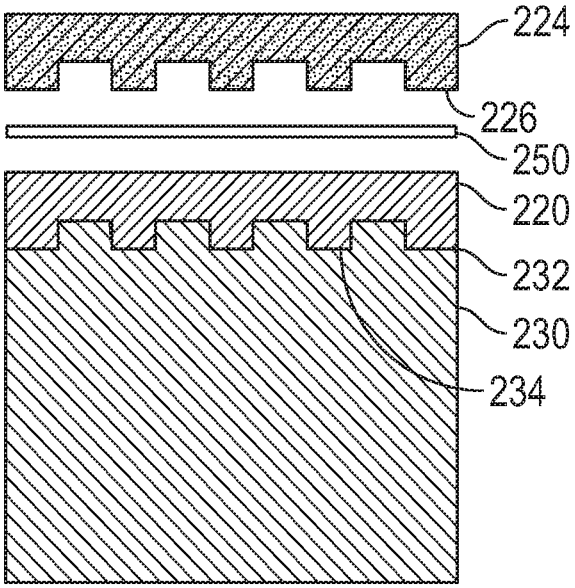
FIG. 8 is a schematic diagram of the leached PCD upper layer, a barrier layer, and an unleached PCD lower layer, and a second substrate, according to some embodiments.

As shown in FIG. 8, a barrier layer 250 can be provided between the upper layer 224 and a lower layer 220. The barrier layer 250 can prevent a catalyzing material from sweeping into the leached upper layer 224 from the lower layer 220. The barrier layer 250 can include a film of metallic material that does not melt in a HPHT process. For example, the barrier layer 250 can include a metal that has a melting point above the melting point of the catalyzing material and/or the temperature of the HPHT process to which the barrier layer 250 is subject. The barrier layer 250 can include titanium, chromium, iridium, niobium, zirconium, or combinations thereof.

Figure 9:
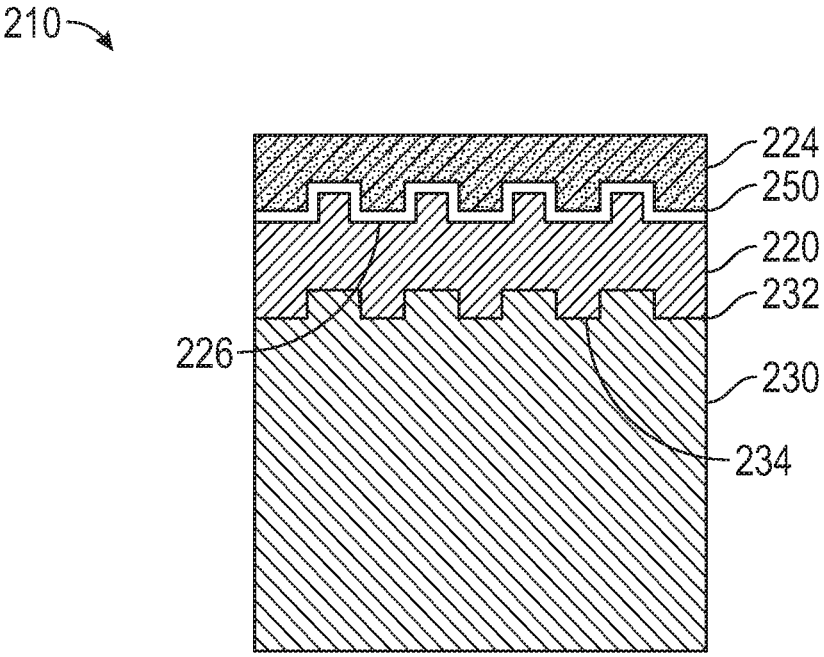
FIG. 9 is a schematic diagram of a cutting element including the leached PCD upper layer, the barrier layer, and the unleached PCD lower layer integrally formed on the second substrate, according to some embodiments.

As shown in FIG. 9, the upper layer 224 and the lower layer 220 can be formed on a second substrate 230 having a second surface feature 234. The second surface feature 234 can include a texture, a pattern, a surface roughness, protrusions, peaks, valleys, grooves, and combinations thereof. The second surface feature 234 can be the same as or different from the first surface feature 244. As the lower layer 220 is applied as a powder to the second substrate 230, the powder can substantially conform to the second surface feature 234 of the second substrate 230. As the upper layer 224, now hardened, is applied to the barrier layer 250 and the lower layer 220, the film of the barrier layer 250 and the powder of the lower layer 220 can substantially conform to the upper surface feature 226 of the upper layer 224. Accordingly, a nonplanar barrier layer 250 is formed between the upper layer 224 and the lower layer 220, and a nonplanar boundary 232 is formed between the lower layer 220 and the second substrate 230. The surface roughness of the second surface feature 234 and/or the nonplanar boundary 222 can be the same as or different from the surface roughness of the first surface feature 244 and/or the nonplanar boundary 242. For example, the surface roughness of the second surface feature 234 and/or the nonplanar boundary 222 can be greater than a minimum, maximum, or average grain size of the lower layer 220. The upper layer 224, the lower layer 220, and the second substrate 230 can be subjected to a HPHT process, for example, with catalyzing material to promote the formation of intercrystalline bonds. The resulting cutting element 210 can include the leached upper layer 224, the barrier layer 250, the unleached lower layer 220, and the second substrate 230, wherein the barrier layer 250 between the upper layer 224 and the lower layer 220 is nonplanar, and wherein the boundary 232 between the lower layer 220 and the second substrate 230 is nonplanar.

Any number of layers can be included in the cutting element 210. For example, the upper layer 224 and the lower layer 220 can be removed from the second substrate 230. These layers can be leached of a catalyzing material as described above. Further, upper and/or lower surfaces of any of such layers can be nonplanar, as discussed herein with respect to some embodiments. An additional layer can be provided, as a powder, between the existing layers and the same or a new substrate. Appropriate surface features can be provided to promote formation of nonplanar boundaries. The layers and the substrate can be subjected to a HPHT process, for example, with catalyzing material to promote the formation of intercrystalline bonds. Barrier layers 250 can be provided as appropriate to prevent sweeping of the catalyzing material into leached layers. This process can be repeated as desired to form any number of layers, which can be joined by nonplanar boundaries.

Figure 10:
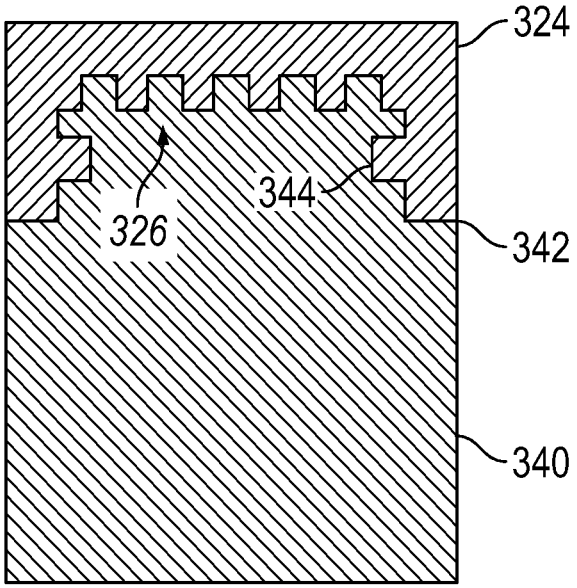
FIG. 10 is a schematic diagram of a PCD upper layer formed on a first substrate, according to some embodiments.
Figure 11:
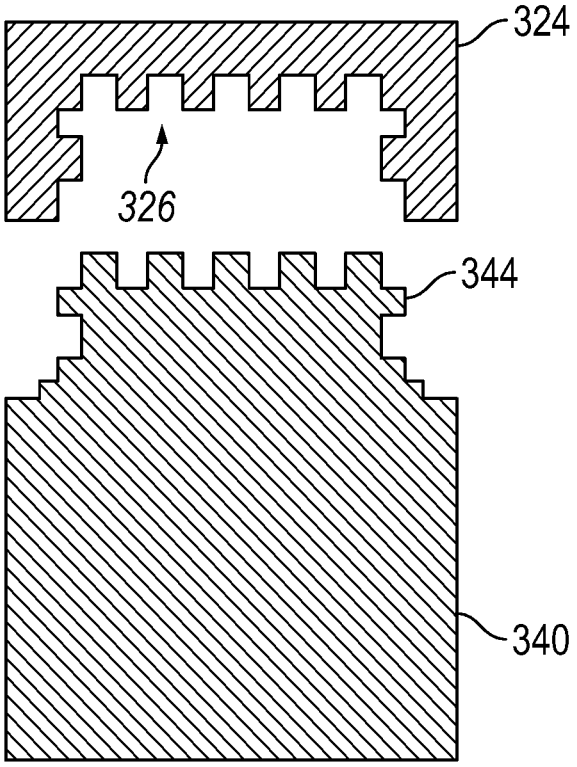
FIG. 11 is a schematic diagram of the PCD upper layer separated from the first substrate, according to some embodiments.
Figure 12:
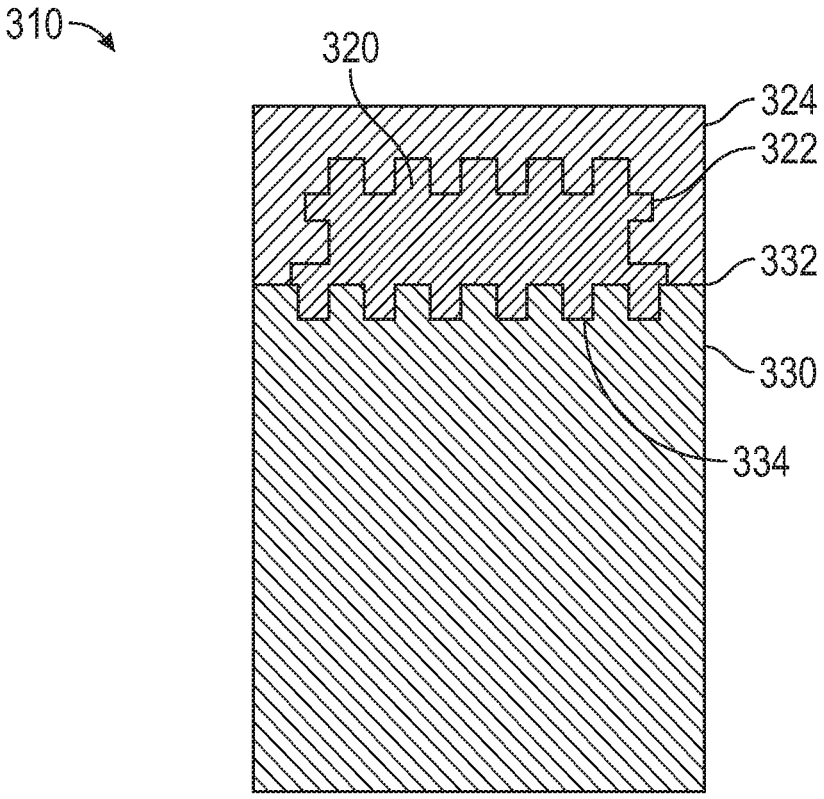
FIG. 12 is a schematic diagram of a cutting element including the PCD upper layer and a PCD lower layer integrally formed on a second substrate, according to some embodiments.

Referring now to FIGS. 10-12, multiple layers of a PCD body can be integrally formed with a substrate to produce a cutting element 310 that is similar in at least some respects to the cutting element 10 of FIG. 2. The cutting element 310 can include multiple PCD layers having different characteristics, and a nonplanar boundary can be formed between the separate layers to provide crack mitigation at the boundary. The layers can be provided such that an uppermost layer also provides a radially outermost shell for one or more layers encompassed therein.

As shown in FIG. 10, an upper layer 324 can be formed on a first substrate 340 having a first surface feature 344. The first surface feature 344 can include a texture, a pattern, a surface roughness, protrusions, peaks, valleys, grooves, and combinations thereof. The first surface feature 344 can also include a mandrel-like protrusion that extends above other portions of the first substrate 340. As the upper layer 324 is applied as a powder to the first substrate 340, the powder can substantially conform to the first surface feature 344 of the first substrate 340. Accordingly, a nonplanar boundary 342 is formed between the upper layer 324 and the first substrate 340, and the upper layer 324 can extend about the sides of the mandrel-like protrusion. The surface roughness of the first surface feature 344 and/or the nonplanar boundary 342 can be greater than a minimum, maximum, or average grain size of the upper layer 324. For example, the first surface feature 344 and/or of the nonplanar boundary 342 can include a minimum, maximum, or average surface roughness (e.g., peak-to-trough height) that is at least about 1.5 times, about 2.0 times, about 2.5 times, about 3.0 times, about 3.5 times, about 4.0 times, about 4.5 times, about 5.0 times, about 5.5 times, or about 6.0 times a minimum, maximum, or average grain size of the upper layer 324. By further example, the first surface feature 344 and/or of the nonplanar boundary 342 can include a minimum, maximum, or average surface roughness (e.g., peak-to-trough height) that is at least about 10 μm, about 20 μm, about 30 μm, about 40 μm, about 50 μm, about 60 μm, about 70 μm, about 80 μm, about 90 μm, or about 100 μm. The upper layer 324 and the first substrate 340 can be subjected to a HPHT process, for example, with catalyzing material to promote the formation of intercrystalline bonds. Alternatively or in combination, the upper layer 324 can be formed on the first substrate 340 without a HPHT process. For example, the upper layer 324 can be 3D printed, laser sintered, and/or stamped onto the first substrate 340. An adhesive or other binding material can be provided to bond the upper layer 324 together. The upper layer 324 can include binder-coated diamond that is printed.

As shown in FIG. 11, the upper layer 324 can be removed from the first substrate 340. In some embodiments, the first substrate 340 is permanently altered or destroyed to separate it from the upper layer 324, for example by a laser of EDM process. After removal, the upper layer 324 can maintain an upper surface feature 326 corresponding to the first surface feature 344 of the first substrate 340. For example, the upper surface feature 326 can include a recess corresponding to the shape of the mandrel-like protrusion of the first substrate 340.

As shown in FIG. 12, the upper layer 324 and a lower layer 320 can be formed on a second substrate 330 having a second surface feature 334. The second surface feature 334 can include a texture, a pattern, a surface roughness, protrusions, peaks, valleys, grooves, and combinations thereof. As the lower layer 320 is applied as a powder to the second substrate 330, the powder can substantially conform to the second surface feature 334 of the second substrate 330. Unlike the first surface feature 344 of the first substrate 340, the second surface feature 334 can omit the mandrel-like protrusion such that, as the upper layer 324 is applied to the lower layer 320, the powder of the lower layer 320 can substantially conform to the upper surface feature 326 of the upper layer 324, including the recess of the upper surface feature 326. Accordingly, the upper layer 324 forms a shell above and radially about at least a portion of the lower layer 320. The upper layer 324 can contact or extend near the second substrate 330. A nonplanar boundary 322 can be formed between the upper layer 324 and the lower layer 320, and a nonplanar boundary 332 can be formed between the lower layer 320 and the second substrate 330. The surface roughness of the second surface feature 334 and/or the nonplanar boundary 322 can be the same as or different from the surface roughness of the first surface feature 344 and/or the nonplanar boundary 342. For example, the surface roughness of the second surface feature 334 and/or the nonplanar boundary 322 can be greater than a minimum, maximum, or average grain size of the lower layer 320. The upper layer 324, the lower layer 320, and the second substrate 330 can be subjected to a HPHT process, for example, with catalyzing material to promote the formation of intercrystalline bonds. The resulting cutting element 310 can include the upper layer 324, the lower layer 320, and the second substrate 330, wherein the boundary 322 between the upper layer 324 and the lower layer 320 is nonplanar, and wherein the boundary 332 between the lower layer 320 and the second substrate 330 is nonplanar.

The lower layer 320 can include a grain size that is coarser than a grain size of the upper layer 324. For example, the minimum, maximum, or average grain size of the upper layer 324 can be at most about 10 μm, about 20 μm, about 30 μm, about 40 μm, about 50 μm, about 60 μm, about 70 μm, about 80 μm, about 90 μm, or about 100 μm, and the minimum, maximum, or average grain size of the lower layer 320 can be at least about 10 μm, about 20 μm, about 30 μm, about 40 μm, about 50 μm, about 60 μm, about 70 μm, about 80 μm, about 90 μm, or about 100 μm. By further example, the minimum, maximum, or average grain size of the lower layer 320 can be at least about 1.5 times, about 2.0 times, about 2.5 times, about 3.0 times, about 3.5 times, or about 4.0 times of the minimum, maximum, or average grain size of the upper layer 324. By further example, the minimum, maximum, or average grain size of the lower layer 320 can be at least about 10 μm, about 20 μm, about 30 μm, about 40 μm, about 50 μm, about 60 μm, about 70 μm, about 80 μm, about 90 μm, or about 100 μm greater than the minimum, maximum, or average grain size of the upper layer 324.

Any number of layers can be included in the cutting element 310. For example, the upper layer 324 and the lower layer 320 can be removed from the second substrate 330. An additional layer can be provided, as a powder, between the existing layers and the same or a new substrate. Appropriate surface features can be provided to promote formation of nonplanar boundaries. The layers and the substrate can be subjected to a HPHT process, for example, with catalyzing material to promote the formation of intercrystalline bonds. This process can be repeated as desired to form any number of layers, which can be joined by nonplanar boundaries.

Referring now to FIGS. 13-16, multiple layers of a PCD body can be integrally formed with a substrate to produce a cutting element 410 that is similar in at least some respects to the cutting element 10 of FIG. 2. The cutting element 210 can include multiple PCD layers having different characteristics, such as presence or absence of catalyzing material, and a nonplanar boundary can be formed between the separate layers to provide crack mitigation at the boundary. The layers can be provided such that an uppermost layer also provides a radially outermost shell for one or more layers encompassed therein.

Figure 13:
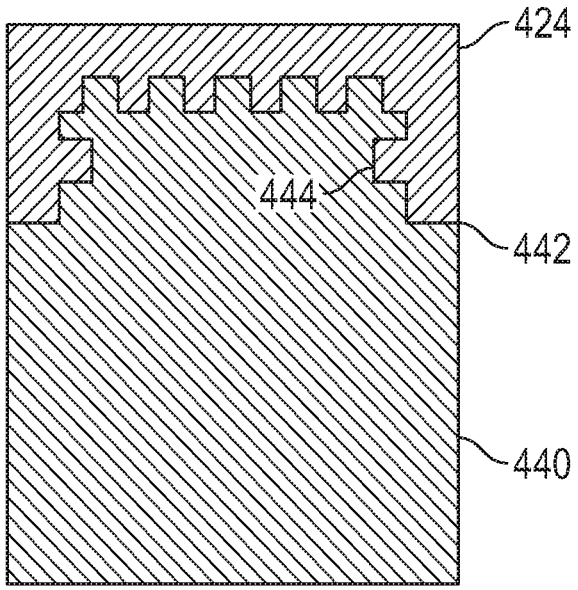
FIG. 13 is a schematic diagram of a PCD upper layer formed on a first substrate, according to some embodiments.

As shown in FIG. 13, an upper layer 424 can be formed on a first substrate 440 having a first surface feature 444. The first surface feature 444 can include a texture, a pattern, a surface roughness, protrusions, peaks, valleys, grooves, and combinations thereof. The first surface feature 444 can also include a mandrel-like protrusion that extends above other portions of the first substrate 440. As the upper layer 424 is applied as a powder to the first substrate 440, the powder can substantially conform to the first surface feature 444 of the first substrate 440. Accordingly, a nonplanar boundary 442 is formed between the upper layer 424 and the first substrate 440, and the upper layer 424 can extend about the sides of the mandrel-like protrusion. The surface roughness of the first surface feature 444 and/or the nonplanar boundary 442 can be greater than a minimum, maximum, or average grain size of the upper layer 424. For example, the first surface feature 444 and/or of the nonplanar boundary 442 can include a minimum, maximum, or average surface roughness (e.g., peak-to-trough height) that is at least about 1.5 times, about 2.0 times, about 2.5 times, about 3.0 times, about 3.5 times, about 4.0 times, about 4.5 times, about 5.0 times, about 5.5 times, or about 6.0 times a minimum, maximum, or average grain size of the upper layer 424. By further example, the first surface feature 444 and/or of the nonplanar boundary 442 can include a minimum, maximum, or average surface roughness (e.g., peak-to-trough height) that is at least about 10 μm, about 20 μm, about 30 μm, about 40 μm, about 50 μm, about 60 μm, about 70 μm, about 80 μm, about 90 μm, or about 100 μm. The upper layer 424 and the first substrate 440 can be subjected to a HPHT process, for example, with catalyzing material to promote the formation of intercrystalline bonds. Alternatively or in combination, the upper layer 424 can be formed on the first substrate 440 without a HPHT process. For example, the upper layer 424 can be 3D printed, laser sintered, and/or stamped onto the first substrate 440. An adhesive or other binding material can be provided to bond the upper layer 424 together. The upper layer 424 can include binder-coated diamond that is printed.

Figure 14:
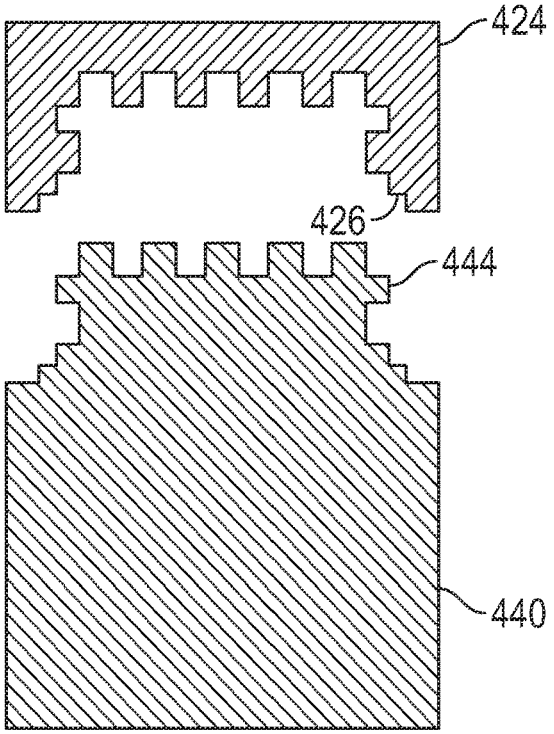
FIG. 14 is a schematic diagram of the PCD upper layer separated from the first substrate, according to some embodiments.

As shown in FIG. 14, the upper layer 424 can be removed from the first substrate 440. In some embodiments, the first substrate 440 is permanently altered or destroyed to separate it from the upper layer 424, for example by a laser of EDM process. After removal, the upper layer 424 can maintain an upper surface feature 426 corresponding to the first surface feature 444 of the first substrate 440. For example, the upper surface feature 426 can include a recess corresponding to the shape of the mandrel-like protrusion of the first substrate 440. The upper layer 424 can be subjected to a leaching process to remove at least some of the catalyzing material from the upper layer 424. The upper layer 424 can be leached to a depth that extends partially or completely through the body of the upper layer 424. The leaching can be performed upon one, some, or all sides, such that the leach depth need not be a full dimension across the upper layer 424. For example, the leach depth can be at least half and less than a full distance across opposing sides of the upper layer 424.

Figure 15:
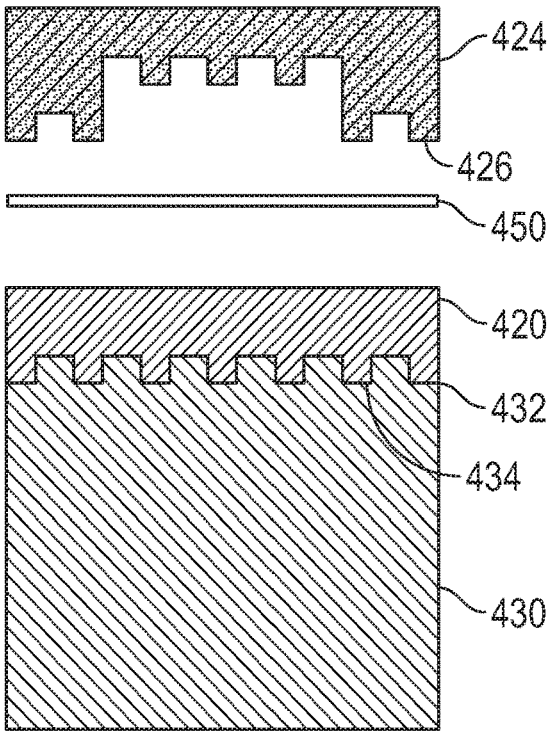
FIG. 15 is a schematic diagram of the leached PCD upper layer, a barrier layer, and an unleached PCD lower layer, and a second substrate, according to some embodiments.

As shown in FIG. 15, a barrier layer 450 can be provided between the upper layer 424 and a lower layer 420. The barrier layer 450 can prevent a catalyzing material from sweeping into the leached upper layer 424 from the lower layer 420. The barrier layer 450 can include a film of metallic material that does not melt in a HPHT process. For example, the barrier layer 450 can include a metal that has a melting point above the melting point of the catalyzing material and/or the temperature of the HPHT process to which the barrier layer 450 is subject.

Figure 16:
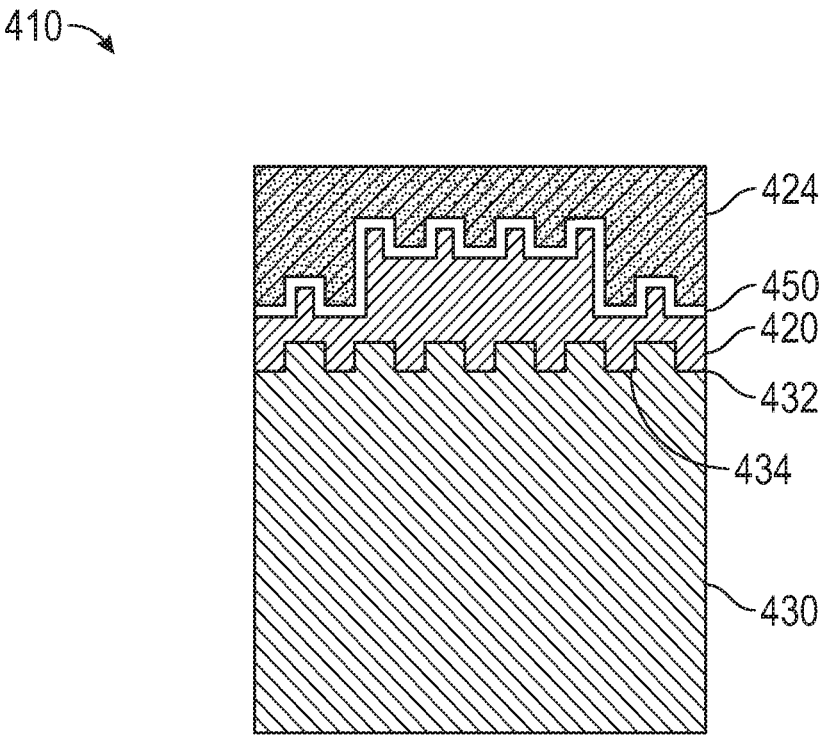
FIG. 16 is a schematic diagram of a cutting element including the leached PCD upper layer, the barrier layer, and the unleached PCD lower layer integrally formed on the second substrate, according to some embodiments.

As shown in FIG. 16, the upper layer 424 and a lower layer 420 can be formed on a second substrate 430 having a second surface feature 434. The second surface feature 434 can include a texture, a pattern, a surface roughness, protrusions, peaks, valleys, grooves, and combinations thereof. As the lower layer 420 is applied as a powder to the second substrate 430, the powder can substantially conform to the second surface feature 434 of the second substrate 430. Unlike the first surface feature 444 of the first substrate 440, the second surface feature 434 can omit the mandrel-like protrusion such that, as the upper layer 424 is applied to the barrier layer 450 and the lower layer 420, the film of the barrier layer 450 and the powder of the lower layer 420 can substantially conform to the upper surface feature 426 of the upper layer 424, including the recess of the upper surface feature 426. Accordingly, the upper layer 424 forms a shell above and radially about at least a portion of the barrier layer 450 and the lower layer 420. The upper layer 424 can contact or extend near the second substrate 430. A nonplanar barrier layer 450 can be formed between the upper layer 424 and the lower layer 420, and a nonplanar boundary 432 can be formed between the lower layer 420 and the second substrate 430. The surface roughness of the second surface feature 434 and/or the nonplanar boundary 422 can be the same as or different from the surface roughness of the first surface feature 444 and/or the nonplanar boundary 442. For example, the surface roughness of the second surface feature 134 and/or the nonplanar boundary 422 can be greater than a minimum, maximum, or average grain size of the lower layer 420. The upper layer 424, the lower layer 420, and the second substrate 430 can be subjected to a HPHT process, for example, with catalyzing material to promote the formation of intercrystalline bonds. The resulting cutting element 410 can include the leached upper layer 424, the barrier layer 450, the unleached lower layer 420, and the second substrate 430, wherein the barrier layer 450 between the upper layer 424 and the lower layer 420 is nonplanar, and wherein the boundary 432 between the lower layer 420 and the second substrate 430 is nonplanar.

Any number of layers can be included in the cutting element 410. For example, the upper layer 424 and the lower layer 420 can be removed from the second substrate 430. These layers can be leached of a catalyzing material as described above. An additional layer can be provided, as a powder, between the existing layers and the same or a new substrate. Appropriate surface features can be provided to promote formation of nonplanar boundaries. The layers and the substrate can be subjected to a HPHT process, for example, with catalyzing material to promote the formation of intercrystalline bonds. Barrier layers 450 can be provided as appropriate to prevent sweeping of the catalyzing material into leached layers. This process can be repeated as desired to form any number of layers, which can be joined by nonplanar boundaries.

Figure 17:
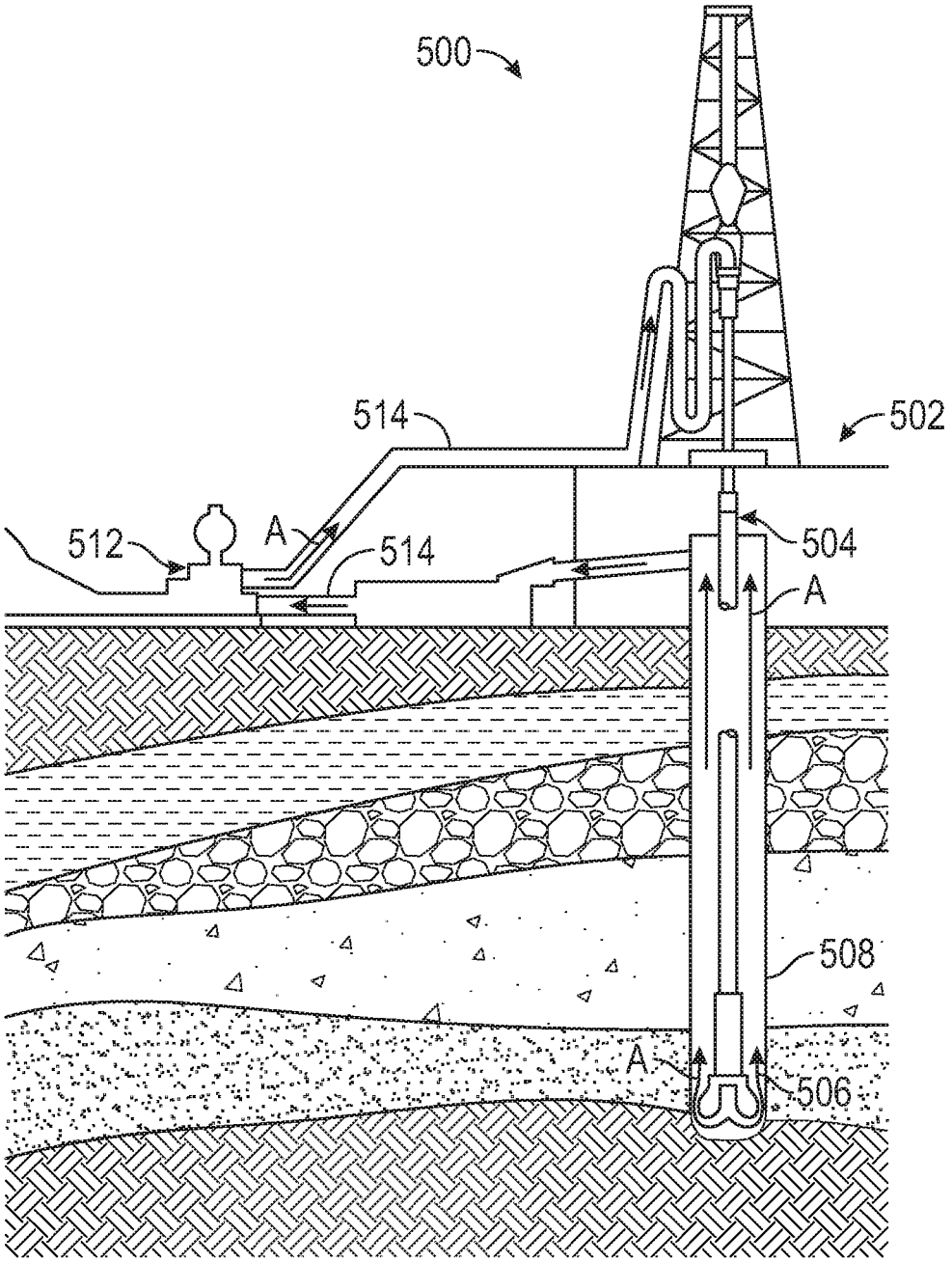
FIG. 17 is a schematic diagram showing one example of a drilling assembly suitable for use in conjunction with a drill bit that includes cutting elements of the present disclosure, according to some embodiments.

FIG. 17 is a schematic showing one example of a drilling assembly 500 suitable for use in conjunction with matrix drill bits that include the cutters of the present disclosure (e.g., drill bit 1 of FIG. 1 with cutting elements 10, 110, 210, 310, and/or 410). It should be noted that while FIG. 17 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 500 includes a drilling platform 502 coupled to a drill string 504. The drill string 504 may include, but is not limited to, drill pipe and coiled tubing, as generally known to those skilled in the art apart from the particular teachings of this disclosure. A matrix drill bit 506 according to the embodiments described herein is attached to the distal end of the drill string 504 and is driven either by a downhole motor and/or via rotation of the drill string 504 from the well surface. As the drill bit 506 rotates, it creates a wellbore 508 that penetrates the subterranean formation 510. The drilling assembly 500 also includes a pump 512 that circulates a drilling fluid through the drill string (as illustrated as flow arrows A) and other pipes 514.

One skilled in the art would recognize the other equipment suitable for use in conjunction with drilling assembly 500, which may include, but is not limited to, retention pits, mixers, shakers (e.g., shale shaker), centrifuges, hydrocyclones, separators (including magnetic and electrical separators), desilters, desanders, filters (e.g., diatomaceous earth filters), heat exchangers, and any fluid reclamation equipment. Further, the drilling assembly may include one or more sensors, gauges, pumps, compressors, and the like. While the present disclosure can relate to components of a drill bit, other applications are contemplated, such as bearing apparatuses, wire-drawing dies, machining equipment, and other articles and apparatuses.

Further Considerations

Various examples of aspects of the disclosure are described below as clauses for convenience. These are provided as examples, and do not limit the subject technology.

Clause A. A cutting element comprising: a first layer of polycrystalline diamond having a first grain size; a second layer of polycrystalline diamond having a second grain size, different from the first grain size, wherein a boundary between the first layer and the second layer is nonplanar; and a substrate, wherein the second layer is between the first layer and the substrate.

Clause B. A method of forming a cutting element, the method comprising: forming, from diamond grains having a first grain size, a first layer of polycrystalline diamond on a first substrate; removing the first layer from the first substrate; and forming, from diamond grains having a second grain size that is different from the first grain size, a second layer of polycrystalline diamond between the first layer and a second substrate, wherein a boundary between the first layer and the second layer is nonplanar.

Clause C. A cutting element comprising: a first layer of polycrystalline diamond without a catalyzing material; a nonplanar barrier layer comprising a metallic film; a second layer of polycrystalline diamond with a catalyzing material; and a substrate, wherein the barrier layer is between the first layer and the second layer and the second layer is between the barrier layer and the substrate.

Clause D. A method of forming a cutting element, the method comprising: forming a first layer of polycrystalline diamond on a first substrate; removing the first layer from the first substrate; leaching a catalyzing material from the first layer; and forming a second layer of polycrystalline diamond between the first layer and a second substrate, wherein a boundary between the first layer and the second layer is nonplanar, wherein while forming the second layer, catalyzing material from the second layer does not sweep into the first layer.

In one or more aspects, examples of additional clauses are described below.

The first grain size can be smaller than the second grain size. A boundary between the second layer and the substrate can be nonplanar. The first layer can extend about a radially outermost periphery of at least a portion of the second layer. The second layer can be entirely encapsulated by the first layer and the substrate. The first substrate can include a nonplanar surface upon which the first layer is formed.

A barrier layer can be formed at the boundary. The barrier layer comprises a metal having a melting point higher than a melting point of the catalyzing material. Forming the second layer can include exposing the barrier layer to a temperature that is lower than a melting point of a metal of the barrier layer. The barrier layer can prevent the catalyzing material from the second layer from sweeping into the first layer.

The first layer may not contain a catalyzing material. The first layer can be leached.

A drill bit can include at least one of the cutting element.

After removing the first layer and before forming the second layer, a method can include leaching a catalyzing material from the first layer. Forming the first substrate can include positioning the first layer about a radially outermost protrusion of the first substrate. Forming the second layer can include positioning the first layer about a radially outermost periphery of at least a portion of the second layer. The leaching can include leaching the catalyzing material from all exterior surfaces of the first layer.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A cutting element comprising:

a first layer of polycrystalline diamond having a first grain size;

a second layer of polycrystalline diamond having a second grain size, wherein the first grain size is smaller than the second grain size, wherein a boundary between the first layer and the second layer is nonplanar and provides stress concentrators comprising surfaces intersecting at ninety-degree angles that direct forces away from the non-planar boundary and into the first layer, the second layer, or some combination thereof; and a substrate, wherein the second layer is between the first layer and the substrate.

2. The cutting element of claim 1, further comprising a barrier layer at the boundary.

3. The cutting element of claim 2, wherein the barrier layer comprises a metal having a melting point higher than a melting point of a catalyzing material.

4. The cutting element of claim 1, wherein the first layer does not contain a catalyzing material.

5. The cutting element of claim 1, wherein the first layer is leached.

6. The cutting element of claim 1, wherein the first layer extends about a radially outermost periphery of at least a portion of the second layer.

7. The cutting element of claim 1, wherein the second layer is entirely encapsulated by the first layer and the substrate.

8. The cutting element of claim 1, further comprising a third layer of polycrystalline diamond having a third grain size, wherein the third layer is disposed adjacent the first layer.

9. The cutting element of claim 8, wherein the third grain size is smaller than the first grain size.

10. The cutting element of claim 8, wherein a boundary between the first layer and the third layer is non-planar.

* * * * *